US007204233B2

(12) United States Patent
Nagai

(10) Patent No.: US 7,204,233 B2
(45) Date of Patent: Apr. 17, 2007

(54) COMMON RAIL FUEL INJECTION SYSTEM

(75) Inventor: Koichi Nagai, Toyoake (JP)

(73) Assignee: DENSO Corporation (JP)

( * ) Notice: Subject to any disclaimer, the term of this patent is extended or adjusted under 35 U.S.C. 154(b) by 0 days.

(21) Appl. No.: 11/227,090

(22) Filed: Sep. 16, 2005

(65) Prior Publication Data

US 2006/0065242 A1 Mar. 30, 2006

(30) Foreign Application Priority Data

Sep. 29, 2004 (JP) ..... 2004-284155

(51) Int. Cl.
*F02M 1/00* (2006.01)

(52) U.S. Cl. ..... 123/447; 123/456

(58) Field of Classification Search ..... 123/435, 123/447, 456, 467, 457, 459, 460, 506
See application file for complete search history.

(56) References Cited

U.S. PATENT DOCUMENTS

| | | | | |
|---|---|---|---|---|
| 5,727,525 | A | 3/1998 | Tsuzuki | |
| 6,119,655 | A | 9/2000 | Heinitz et al. | |
| 6,722,345 | B2 * | 4/2004 | Saeki et al. | 123/435 |
| 6,805,105 | B2 * | 10/2004 | Kato et al. | 123/514 |
| 6,854,445 | B2 * | 2/2005 | Okamoto | 123/446 |
| 2003/0084871 | A1 * | 5/2003 | Uchiyama et al. | 123/339.15 |
| 2004/0194762 | A1 * | 10/2004 | Okamoto | 123/458 |

FOREIGN PATENT DOCUMENTS

| | | | |
|---|---|---|---|
| DE | 10016242 | A1 | 10/2001 |
| DE | 10031066 | A1 | 1/2002 |
| EP | 1262659 | A2 | 5/2002 |
| JP | 4-308357 | | 10/1992 |
| JP | 2001-182638 | | 7/2001 |
| JP | 2001-207926 | | 8/2001 |
| JP | 2002-371940 | | 12/2002 |
| WO | WO 02/25151 | A1 | 3/2002 |

* cited by examiner

*Primary Examiner*—John T. Kwon
(74) *Attorney, Agent, or Firm*—Nixon & Vanderhye PC

(57) ABSTRACT

A pressure-reduction valve that returns fuel in a common rail to a low-pressure system is such one that a valve-opening pressure of the valve device is changed by an actuator into a target common rail pressure. Thus, when the actual common rail pressure in the common rail exceeds the target common rail pressure, the pressure-reduction valve opens at once. On the contrary, when the actual common rail pressure in the common rail decreases to reach the target common rail pressure, the pressure-reduction valve closes at once. Accordingly, the pressure-reduction valve limits an overshoot and an undershoot of the actual common rail pressure to a minimum without being influenced by a fuel temperature or by detection timings of the common rail pressure sensor.

9 Claims, 4 Drawing Sheets

COMMON RAIL FUEL INJECTION SYSTEM

CROSS REFERENCE TO RELATED APPLICATION

This application is based upon and claims the benefit of priority of Japanese Patent Application No. 2004-284155 filed on Sep. 29, 2004, the content of which is incorporated herein by reference.

FIELD OF THE INVENTION

The present invention relates to a common rail fuel injection system for an internal combustion engine, and especially relates to the common rail fuel injection system provided with a regulator to keep a common rail pressure accumulated in a common rail at a target value.

In the followings, "actual common rail pressure" means an actual value of the common rail pressure accumulated in the common rail, "detected common rail pressure" means a detection value of the common rail pressure detected by a common rail pressure sensor, and "target common rail pressure" means a targeted value of the common rail pressure that is calculated in accordance with a driving state of an engine.

BACKGROUND OF THE INVENTION

Conventionally, a common rail fuel injection system calculates a target common rail pressure in accordance with an driving state of an engine, and controls an actual common rail pressure of high-pressure fuel accumulated in a common rail to be the target common rail pressure by a discharge amount of a high-pressure pump, which supplies the high-pressure fuel to the common rail, and by opening and closing a pressure-reduction valve to leak the high-pressure fuel accumulated in the common rail to a low-pressure system.

The pressure-reduction valve is for opening and closing a passage communicating an interior space of the common rail and the low-pressure system. A conventional pressure-reduction valve is a solenoid valve to open and close the passage communicating the interior space of the common rail and the low-pressure system (refer to U.S. Pat. No. 5,727,525 and its counterpart JP-09-170512-A, for example).

A control method of the conventional pressure-reduction valve is as follows.

When the target common rail pressure rapidly increases, the discharge amount of the high-pressure pump increases in accordance with the increase of the target common rail pressure, and then the actual common rail pressure increases. Here, when a detected common rail pressure detected by a common rail pressure sensor exceeds the target common rail pressure by a predetermined value, a control unit energizes the pressure-reduction valve to leak the high-pressure fuel in the common rail to prevent an overshoot of a transient pressure.

When the target common rail pressure rapidly decreases, the discharge amount of the high-pressure pump decreases in accordance with the decrease of the target common rail pressure. However, it takes some time for the actual common rail pressure to decrease to reach the target common rail pressure just by the decrease of the discharge amount of the high-pressure pump and a fuel consumption of an injector. Thus, when the target common rail pressure decreases, the control unit energizes the pressure-reduction valve to leak the high-pressure fuel in the common rail. Then, when the detected common rail pressure detected by a common rail pressure sensor decreases to be smaller than the target common rail pressure by a predetermined value, the control unit stops energizing the pressure-reduction valve to prevent an undershoot of the transient pressure (refer to JP-2002-371940-A, for example).

A specific control example of the pressure-reduction valve is described referring to FIG. 6.

When the target common rail pressure PC0 (represented by a broken line in the figure) rapidly increases, the discharge amount of the high-pressure pump increases in accordance with the increase of the target common rail pressure PC0, and the actual common rail pressure PCi (represented by a solid line in the figure) increases.

Here, when a detected common rail pressure PCk (dots in the figure) detected by the common rail pressure sensor exceeds the target common rail pressure PC0 by the predetermined value, the control unit energizes the pressure-reduction valve to leak the high-pressure fuel in the common rail. As a result, the actual common rail pressure PCi temporarily exceeds the target common rail pressure PC0 by a value larger than the predetermined value.

Further, the detected common rail pressure PCk detected by the common rail pressure sensor is detected every predetermined sampling frequency, so that sampling timings occurs detection errors in a recognition by the control unit to recognize that the detected common rail pressure PCk exceeds the target common rail pressure PC0 by the predetermined value.

That is, in the conventional art, in the case that the target common rail pressure PC0 rapidly increases, the actual common rail pressure PCi exceeds the target common rail pressure PC0 by the value larger than the predetermined value and the overshoot of the common rail pressure is relatively large, to hinder the injection control from being provided with high accuracies (for example, a poor starting operation, a generation of unusual noise, an emission deterioration and so on).

As in the case when the target common rail pressure PC0 rapidly increases, When the target common rail pressure PC0 rapidly decreases, the control unit stops a power supply to the pressure-reduction valve when the detected pressure PCk detected by the common rail pressure sensor becomes smaller than the target common rail pressure PC0 by a predetermined value, so that the actual common rail pressure PCi temporarily becomes smaller than the target common rail pressure PC0 by the predetermined value.

In a detection of a state that the detected common rail pressure PCk is smaller than the target common rail pressure PC0 by the predetermined value, a detection error occurs by the sampling timings.

That is, conventionally, when the target common rail pressure PC0 rapidly decreases, the actual common rail pressure PCi becomes smaller than the target common rail pressure PC0 by a value larger than the predetermined value, and the errors by the sampling occur. Thus, the undershoot of the common rail pressure becomes large, to hinder the injection control from being provided with high accuracies (for example, a poor starting operation, a generation of unusual noise, an emission deterioration and so on).

Further, an increase speed (increase gradient) and a decrease speed (decrease gradient) vary in accordance with a fuel temperature, so that magnitudes of the above-described overshoot and undershoot vary in accordance with the fuel temperature, and the overshoot and the undershoot are impediments to a stable injection control.

SUMMARY OF THE INVENTION

The present invention is achieved in view of the above-described issues, and has an object to provide a common rail fuel injection system for an internal combustion engine that is able to limit the overshoot and the undershoot of the actual common rail pressure against the target common rail pressure to a minimum without being influenced by the fuel temperature or by detection timings (sampling timings) of the common rail pressure sensor when the target common rail pressure changes.

The common rail fuel injection system has: a high-pressure pump that feeds a high-pressure fuel; a common rail that accumulates the high-pressure fuel fed by the high-pressure pump; an injector that injects the high-pressure fuel accumulated in the common rail; a target common rail pressure calculator that calculates a target common rail pressure in accordance with a driving state of the internal combustion engine; a valve device that opens when an actual common rail pressure in the common rail exceeds a predetermined valve-opening pressure to flow the high-pressure fuel in the common rail to a low-pressure system; and a valve-opening pressure changer that changes the valve-opening pressure of the valve device into the target common rail pressure.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

First Embodiment

A common rail fuel injection system according to a first embodiment of the present invention will be described below referring to FIGS. 1A, 1B, 2 and 3.

Figure 3:
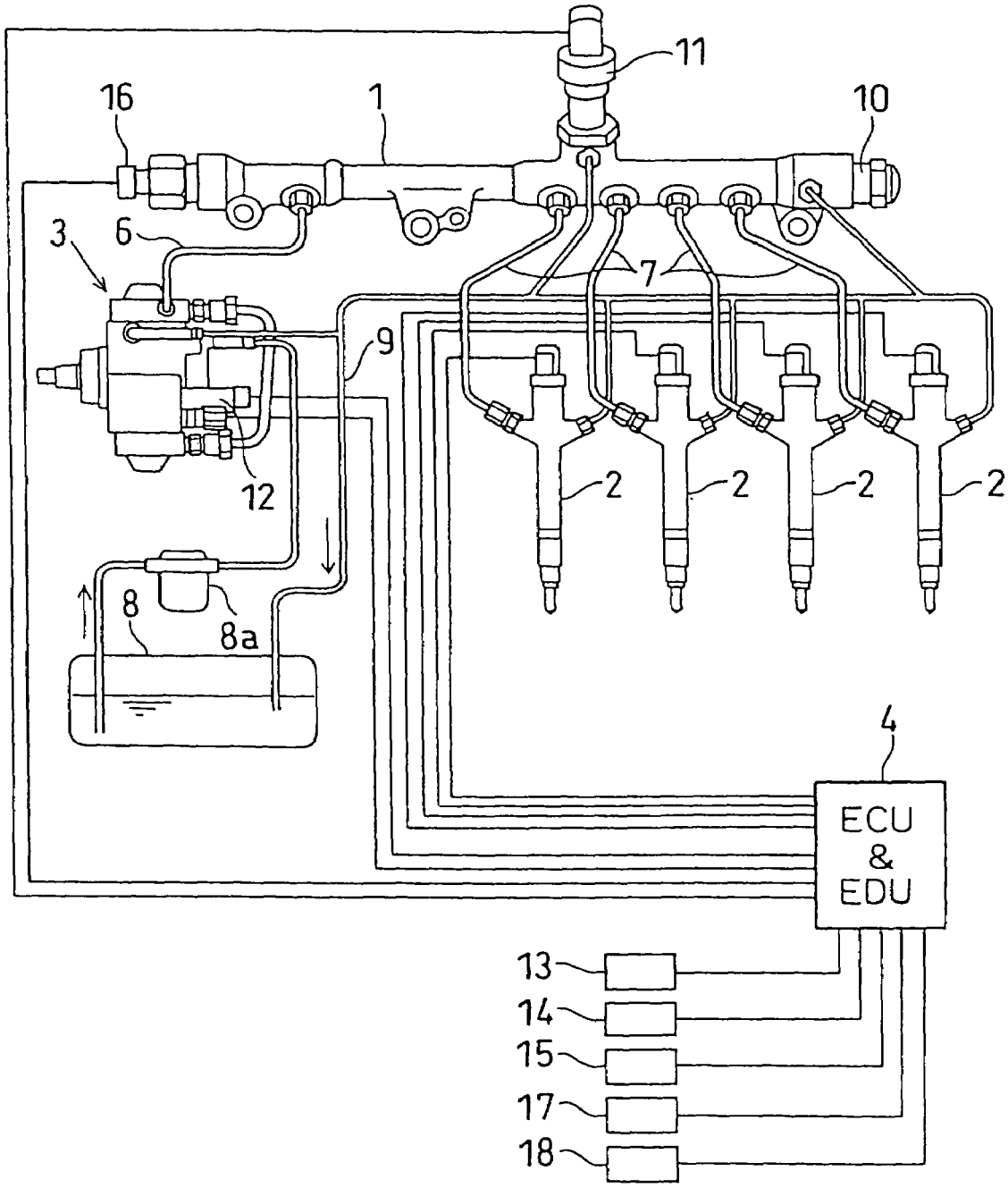
FIG. 3 is a schematic diagram showing a common rail system equipped with the common rail fuel injection system according to the first embodiment.

FIG. 3 schematically depicts the common rail fuel injection system according to the first embodiment, which is for injecting high-pressure fuel in a four-cylinder engine such as a diesel engine (not shown) of a vehicle. The common rail fuel injection system 1 has a common rail 1, an injector 2, a fuel supply pump 3, a control unit 4 and so on. The control unit 4 has an engine control unit (ECU) and an engine driving unit (EDU). In FIG. 3 is shown an example equipped with the ECU and the EDU in one control unit 4, however, the ECU and the EDU may be separately equipped.

The common rail 1 is a pressure-accumulating container to accumulate the high-pressure fuel to be supplied to the injector 2. The common rail 1 is connected via a pump pipe (high-pressure fuel passage) 6 to a discharge port of the fuel supply pump 3 that discharges the high-pressure fuel so as to continuously accumulate the common rail pressure equivalent to the fuel injection pressure, and connected to a plurality of injector pipes 7 that supplies the high-pressure fuel to the respective injectors 2.

A relief pipe 9, which returns the fuel from the common rail 1 to a fuel tank 8, is provided with a pressure limiter 10. The pressure limiter 10 is a relief valve that opens when the actual common rail pressure PCi in the common rail 1 exceeds a preset limit value to limit the actual common rail pressure PCi in the common rail 1 to a value smaller than the preset limit value.

The common rail 1 is provided with a pressure-reduction valve 11 that opens when the actual common rail pressure PCi in the common rail 1 exceeds a predetermined valve-opening pressure (target common rail pressure PC0) to flow the fuel in the common rail 1 to the low-pressure system. A detailed description of the pressure-reduction valve 1 will be given later.

The fuel supply pump 3 is a fuel pump to pressure-feed the high-pressure fuel to the common rail 1, and equipped with a feed pump to suck the fuel in the fuel tank 8 via a fuel filter 8*a* to the fuel supply pump 3 and a high-pressure pump to compress the fuel sucked by the feed pump and pressure-feed the fuel to the common rail 1. The feed pump and the high-pressure pump are driven by an identical camshaft. The camshaft is rotationally driven by the engine.

Further, the fuel supply pump 3 is equipped with a suction control valve (SCV) 12 that controls a fuel amount sucked to the high-pressure pump. The control unit 4 adjusts the SCV 12, so that the actual common rail pressure PCi accumulated in the common rail 1 is adjusted.

The control unit 4 is provided with a microcomputer having a conventional construction including a CPU executing a control process and a calculation process, a memory device (a ROM, a standby RAM or an EEPROM, a RAM and the like) storing respective programs and data, an input circuit, an output circuit, a power source circuit, and functions as an injector driving circuit, a pump driving circuit and so on. Then, the control unit 4 executes respective calculations based on signals of sensors and the like (engine parameters: signals in accordance with a driver's operation state, a driving state of the engine and the like) read by the control unit 4.

The sensors connected to the control unit 4 include: an acceleration sensor 13 for detecting a throttle opening degree; a rotational frequency sensor for detecting rotational frequency of the engine; a coolant temperature sensor 15 for detecting a coolant temperature of the engine; a common rail pressure sensor 16 for detecting a common rail pressure accumulated in the common rail 1; a fuel temperature sensor 17 for detecting a fuel temperature supplied to the injector 2; and other sensors 18.

The control apparatus 4 is provided with: an injection pattern determiner for determining an injection pattern for each fuel injection based on the programs stored in the ROM and the signals of the sensors (driving state of the vehicle) loaded into the RAM; a target injection amount calculator for calculating a target injection amount of each the respective injection; and a target injection timing calculator for calculating an injection start timing of the respective injections, as a control program for the injector 2.

The injection pattern determiner is a control program to determine the injection patterns (a single injection, a multiple injection, etc.) of the injector 2 in accordance with a current driving state of the internal combustion engine.

The target injection amount calculator is a control program to determine the target injection amount in accordance with the current driving state of the internal combustion engine and to determine a commanded injector driving time to realize the target injection amount.

The target injection timing calculator is a control program to determine the target injection timing in accordance with the current driving condition and to determine a injection command timing to start an injection at the target injection timing.

The control unit 4 is provided with: a target common rail pressure calculator for calculating a target common rail pressure PC0 based on the programs stored in the ROM and the signals of the sensors (driving state of the vehicle) loaded into the RAM; a SCV controller for controlling an opening degree of the SCV 12 based on the calculated target common rail pressure PC0; and an actuator controller 29 for changing the valve-opening pressure of the pressure-reduction valve 11 into the target common rail pressure PC0, as a control program for the actual common rail pressure PCi accumulated in the common rail 1.

The target common rail pressure calculator is a control program to calculate the target common rail pressure PC0 with a map or a computing equation in accordance with a current driving state.

The SCV controller is a control program to calculate the opening degree of the SCV to equalize the detected common rail pressure PCk with the target common rail pressure PC0 and to generate a valve-opening signal (a PMW signal, for example) in the SCV driving circuit to realize the opening degree of the SCV in the SCV 12.

A detailed description of the actuator controller 29 will be given later.

The common rail fuel injection system according to the first embodiment is provided with a regulator that keeps the actual common rail pressure PCi accumulated in the common rail 1 to the target common rail pressure PC0 by opening a valve when the actual common rail pressure PCi is larger than the target common rail pressure PC0 calculated by the target common rail pressure calculator to release an excessive pressure to the low-pressure system.

The regulator is composed of a valve device 21 that opens to flow the fuel in the common rail 1 to the low-pressure system in a state that the actual common rail pressure PCi exceeds a predetermined valve-opening pressure, and a valve-opening pressure changer 22 for changing the valve-opening pressure into the target common rail pressure PC0.

Figure 1A:
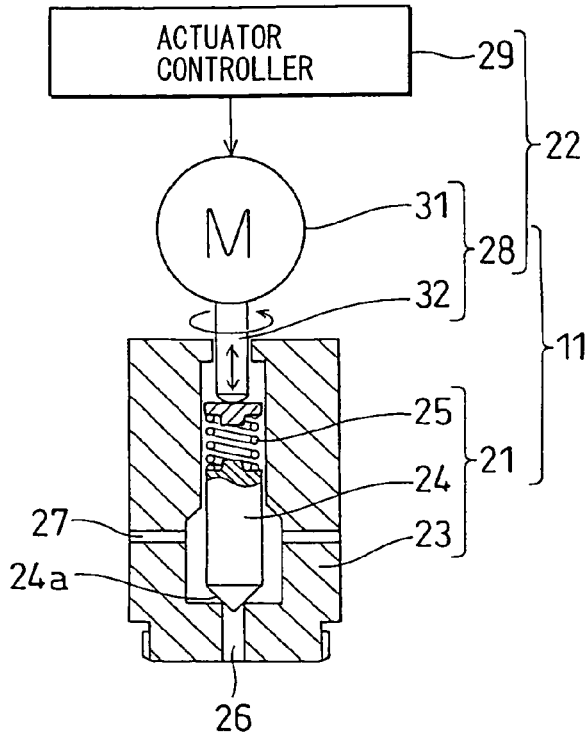
FIG. 1A is a schematic diagram showing a pressure-reduction valve of a common rail fuel injection system according to a first embodiment of the present invention.

The valve device 21 is, as shown in FIG. 1A, composed of a housing (fixing member) 23, a valve body 24 and a spring 25.

The housing 23 is fixed to the common rail by screw-fastening and the like. The housing 23 is provided with a high-pressure passage 26 communicated with a common rail 1 and a low-pressure passage 27 to lead the fuel passed through the high-pressure passage 26 to the relief pipe 9.

The valve body 24 is supported to be movable in an axial direction within the housing 23, and disposed so that a cone valve 24*a* at a leading end thereof blocks the high-pressure passage 26 by the spring force of the spring 25.

The spring 25 is a compression coil spring to push the valve body 24 to a valve-closing direction inside the housing 23, and the valve-opening pressure changes by the changes of the spring force (compression amount) of the compression coil spring.

The valve-opening pressure changer 22 is composed of an actuator 28 and an actuator controller 29 (a part of the control function of the control unit 4).

The actuator 28 varies the spring force (compressed amount) of the spring 25. In the first embodiment, the actuator 28 is composed of a step motor 31 and a rotational/axial direction transformer 32 to transform a rotational shift of the step motor 31 into an axial shift.

Further, the valve device 21 and the actuator 28 are integrally provided as the pressure-reduction valve 11.

The pressure-reduction valve 11 opens when the actual common rail pressure PCi in the common rail 1 is larger than the valve-opening pressure of the valve device 21. That is, by setting the valve-opening pressure of the valve device 21 to the target common rail pressure PC0 by the actuator 28, the pressure-reduction valve 11 opens when the actual common rail pressure PCi is larger than the target common rail pressure PC0, so as to prevent the actual common rail pressure PCi in the common rail 1 from exceeding the target common rail pressure PC0.

Figure 2:
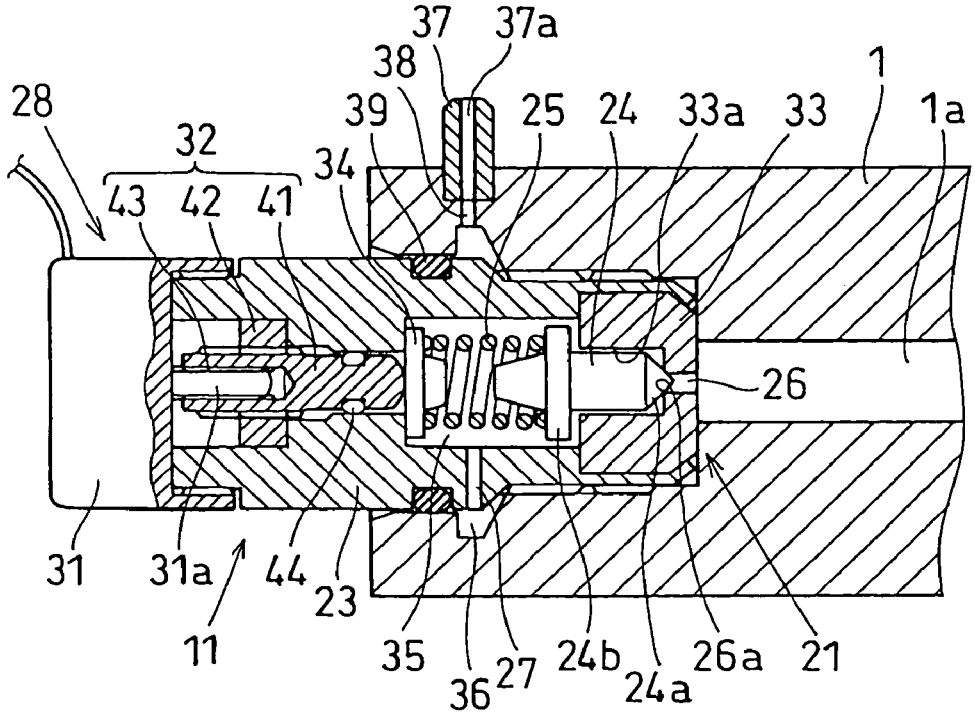
FIG. 2 is a cross-sectional view showing the pressure-reduction valve of the common rail fuel injection system according to the first embodiment.

A specific construction of the pressure-reduction valve 11 is described below referring to FIG. 2.

The housing 23 is fixed to the common rail by screw-fastening. On one end of the housing 23, which is inserted into the common rail 1, is fixed a valve seat body 33, in which a high-pressure passage 26 is formed by crimping and the like. An outer opening at a leading end of the high-pressure passage 26 is communicated with an accumulation passage 1*a* in the common rail 1, and at an inner opening of the high-pressure passage 26 is provided with a seating seat 26 on which the cone valve 24*a* of the valve body 24 seats.

Inside the housing 23 are formed the valve body 24, the spring 25 and a spring room 35 to install a spring seat 34 therein.

An annular groove 36 is formed around the housing 23 in the common rail 1. Further, the low-pressure passage 27 is formed in the housing 23 to communicate the spring room 35 with the annular groove 36. Furthermore, a pipe 37, to which the relief pipe 9 is connected, is fixed to the common rail 1 by press-fitting and the like. A passage 37*a* in the pipe 37 is communicated with the annular groove 36 by a communication hole 38 formed in the common rail 1.

On an outer circumference of the housing 23 is formed a seal groove, and a gap between the common rail 1 and the housing 23 is sealed by an O-shaped ring 39 fixed in the seal groove.

The valve body 24 is supported to be able to slide in a slide hole 33*a* that is formed at a center portion of the valve seat body 33. A clearance is provided between the valve body 24 and the slide hole 33*a* to flow the fuel.

The spring 25 is, as described above, a compression coil spring, and disposed between a valve seat 24*b* provided on the valve body 24 and a spring seat 34 in a compressed state in its axial direction.

The step motor 31 is fixed to the housing 23 in such a state that a rotation shaft 31*a*, which is an output shaft, is inserted into the housing 23.

A rotational/axial direction transformer 32 is composed of a pushing rod 41, which is rotationally driven by the rotation shaft 31*a*, a female screw member (ball screw) 42 fixed in the housing 23 and a spline 43.

The pushing rod 41 is coaxially disposed with the rotation shaft 31*a*, slidable in its axial direction with respect to the rotation shaft 31*a*, integrally rotatable with the rotation shaft 31*a* and coupled to the rotation shaft 31 by the spline 43 in the axial direction. Further, on an outer circumference of the pushing rod 41 is formed a male screw thread to be screw-fastened to an female screw thread of the female screw member 42, and the pushing rod 41 moves in the axial direction by rotating so as to displace the spring seat 34 in the axial direction.

As a result, when the step motor 31 rotates, the pushing rod 41 is displaced in the axial direction in accordance with the rotational amount of the step motor 31 to change the spring force of the spring 25 and to change the valve-opening pressure of the valve device 21. That is, by controlling the rotational amount of the step motor 31, the valve-opening pressure of the pressure-reduction valve 11 can be variably controlled.

On an outer circumference of the pushing rod 41 is formed a seal groove, and a gap between the pushing rod 41 and the housing 23 is sealed by an O-shaped ring 44 fixed in the seal groove.

When the actual common rail pressure PCi in the common rail 1 exceeds the valve-opening pressure of the pressure-reduction valve 11, the cone valve 24*a* of the valve body 24 lifts off the seating seat 26*a* of the valve seat body 33 by the pressure that the valve body 24 receives via the high-pressure passage 26. Then, the fuel in the common rail 1 flows from the high-pressure passage 26 through a gap between the valve body 24 and the valve seat body 33, the spring room 35, the low-pressure passage 27, the annular groove 36, the communication hole 38, the passage 37*a* in the pipe 37, the relief pipe 39, then returns into the fuel tank 8. In this manner, the fuel in the common rail 1 is discharged through the pressure-reduction valve 11 to decrease its pressure to reach the actual common rail pressure PCi. Then, when the actual common rail pressure PCi in the common rail 1 decreases to reach the valve-opening pressure of the pressure-reduction valve 11, the cone valve 24*a* of the valve body 24 seats on the seating seat 26*a* of the valve seat body 33, and the actual common rail pressure PCi is kept to the valve-opening pressure of the pressure-reduction valve 11.

The actuator controller 29 changes the valve-opening pressure into the target common rail pressure PC0 by controlling the actuator 28 installed in the pressure-reduction valve 11. Specifically, the actuator controller 29 executes an open control for the rotational amount (a rotation number and a rotation angle with respect to a predetermined rotational position) of the step motor 31 in accordance with the target common rail pressure PC0.

That is, the actuator controller 29 is provided with a map or a computing equation in advance to determine the rotational amount of the step motor 31 in accordance with the target common rail pressure PC0, and sets the valve-opening pressure of the pressure-reduction valve 11 to the target common rail pressure PC0 by executing the open control for the rotational amount of the step motor 31 based on the target common rail pressure PC0 calculated by the target common rail pressure calculator.

Further, the actuator controller 29 is provided with an initialization means to equalize an open control value of the actuator 28 (a rotational amount of the step motor 31) with the target common rail pressure PC0 prior to a shipment.

The initialization means of the actuator controller 29 executes: (1) a minimum pressure-side initialization operation to store a minimum pressure rotational amount when the pressure-reduction valve 11 opens (or when the pressure-reduction valve 11 is closed) in gradually rotating the step motor 31 in a condition that an actual common rail pressure PCi is generated in the common rail 1 in accordance with a minimum target common rail pressure; and (2) a maximum pressure-side initialization operation to store a maximum pressure rotational amount when the pressure-reduction valve 11 opens (or when the pressure-reduction valve 11 is closed) in gradually rotating the step motor 31 in a condition that an actual common rail pressure PCi is generated in the common rail 1 in accordance with the maximum target common rail pressure.

Then, the actuator controller 29 determines a rotational amount (open control value) in accordance with the target common rail pressure PC0 by an interpolation between the minimum pressure rotational amount and the maximum pressure rotational amount stored in the memory device, in determining the rotational amount (open control value) in accordance with the target common rail pressure PC0 in a normal driving time of the internal combustion engine.

Further, the actuator controller 29 is provided with a learning function that equalizes the detected common rail pressure PCk with the target common rail pressure PC0 when the detected common rail pressure PCk, which is detected by the common rail pressure sensor 16, differs from the target common rail pressure PC0 by correcting an open control value (a rotational amount of the step motor 31) of the actuator 28.

The learning function of the actuator controller 29 operates when the detected common rail pressure PCk detected by the common rail pressure sensor 16 differs from the target common rail pressure PC0 (in such a case that a pressure difference is over a predetermined value) in a learning driving (in an idle time, for example) in which a driving state of the internal combustion engine is stable and the target common rail pressure PC0 is constant. The learning function is composed of: a correction value calculator that determines a correction value (correction rotational amount) of the actuator 28 to eliminate the pressure difference between the detected common rail pressure PCk detected by the common rail pressure sensor 16 and the target common rail pressure PC0; a memorization executor that stores the correction value calculated by the correction value calculator in a memory device in the control unit 4; and a correction executor that corrects the open control value (rotational amount) of the actuator 28 based on the correction value stored in the memory device.

The above-described initialization means can be eliminated by operating the learning function at a time prior to shipment.

Figure 1B:
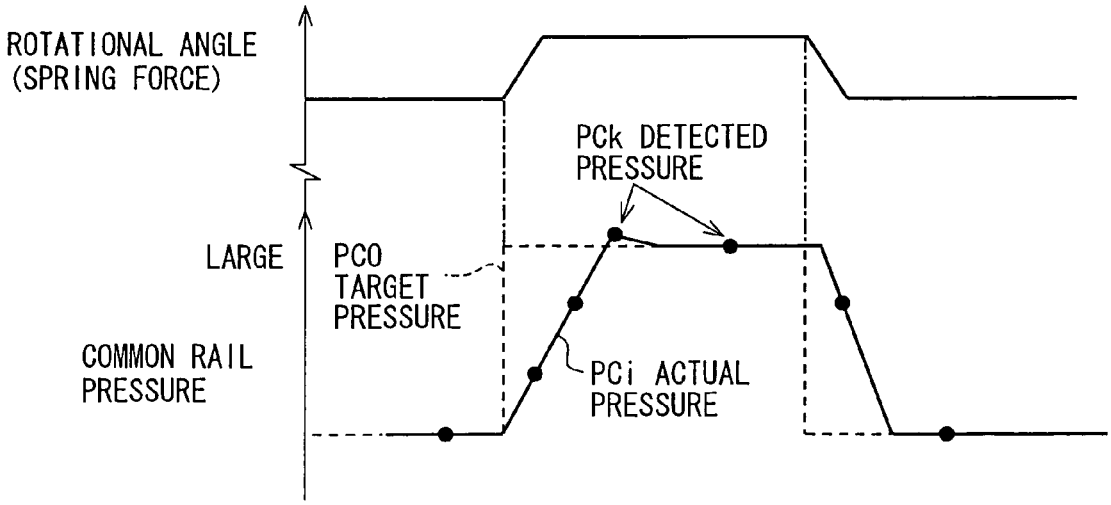
FIG. 1B is a timing chart showing variations of a displacement of a pushing rod, a target common rail pressure and an actual common rail pressure by the common rail fuel injection system according to the first embodiment.

An operation of the common rail fuel injection system according to the first embodiment is described below referring to FIG. 1B.

The common rail fuel injection system is configured so that the actuator 28 changes the valve-opening pressure of the valve device 21 of the pressure-reduction valve 11 in the pressure-reduction valve 11 into the target common rail pressure PC0. When the target common rail pressure PC0 changes in accordance with a change of a driving state of the internal combustion engine, the valve-opening pressure is changed into the target common rail pressure PC0 in accordance with that change.

When the target common rail pressure PC0 (represented by a broken line in the figure) increases, the open control activates the actuator 28 (rotates the step motor 31), the pushing rod 41 is displaced in a direction to increase a compression degree of the spring 25 and the spring force of the spring 25 increases, and the valve-opening pressure of the pressure-reduction valve 11 is changed into the increased target common rail pressure PC0. The opening degree of the SCV 12 is controlled to increase in accordance with the increase of the target common rail pressure PC0 and the discharge amount of the fuel supply pump 3 (high-pressure pump) also increases.

By the increase of the discharge amount from the fuel supply pump (high-pressure pump) 3, the actual common rail pressure PCi (solid line in the figure) increases. When the actual common rail pressure PCi exceeds the target common rail pressure PC0, the pressure-reduction valve 11 opens at once to leak the fuel in the common rail 1 to the low-pressure system, because the valve-opening pressure of the pressure-reduction valve 11 equals the target common rail pressure PC0. As a result, the overshoot of the actual common rail pressure PCi can be limited to a minimum.

When the target common rail pressure PC0 decreases, the open control drives the actuator 28 (rotates the step motor 31) to displace the pushing rod 41 in a direction to reduce a compression of the spring 25, so that the spring force of the spring 25 decreases and the valve-opening pressure of the pressure-reduction valve 11 is changed into a decreased target common rail pressure PC0. The opening degree of the SCV 12 is controlled to be smaller in accordance with a decrease of the target common rail pressure PC0, and the discharge amount of the pressure supply pump 3 (high-pressure pump) is also reduced.

Just after the decrease of the target common rail pressure PC0, the actual common rail pressure PCi is larger than the target common rail pressure PC0 (valve-opening pressure), so that the pressure-reduction valve opens at once to decrease the pressure in the common rail 1 to the target common rail pressure PC0 in a short time.

Then, when the actual common rail pressure PCi decreases to reach the target common rail pressure PC0, the pressure-reduction valve 11 closes at once. As a result, the undershoot of the actual common rail pressure PCi can be limited to a minimum.

As described above, the common rail fuel injection system according to the first embodiment is configured so that the pressure-reduction valve 11 spontaneously opens when the actual common rail pressure PCi in the common rail 1 exceeds the target common rail pressure PC0 (valve-opening pressure) to flow the fuel in the common rail 1 to the low-pressure system. Thus, the common rail fuel injection system is not influenced by the fuel temperature when the target common rail pressure PC0 increases and by the detection timings (sampling timings: refer to the dots in FIG. 1A) by the common rail pressure 16, and the overshoot of the common rail pressure PCi against the target common rail pressure PC0 can be limited to a minimum.

Further, the common rail fuel injection system according to the first embodiment is, as described above, provided with the learning function that corrects the open control value (rotational amount) of the actuator 28 when the detected common rail pressure PCk detected by the common rail pressure 16 differs from the target common rail pressure PC0 to equalize the detected common rail pressure PC0 with the target common rail pressure PC0.

Figure 4:
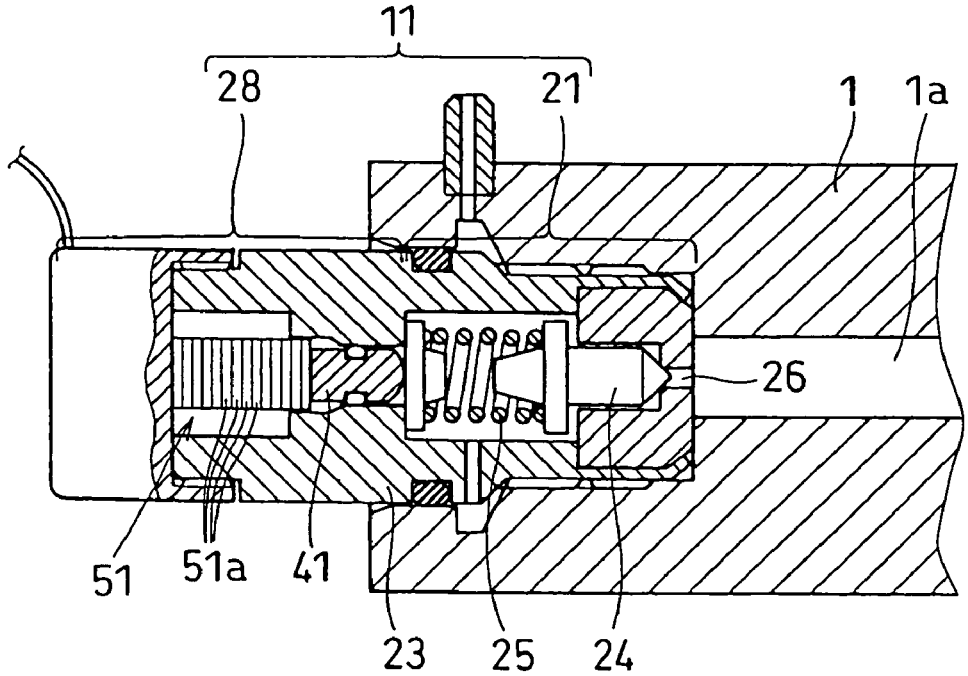
FIG. 4 is a cross-sectional view showing a pressure-reduction valve of a common rail fuel injection system according to a second embodiment.

Thus, when the detected common rail pressure PCk differs from the target common rail pressure PC0 by age deteriorations and the like caused by degradations, etc. of the spring 25 or the spring seat 34, the actuator is controlled with the correction value in accordance with the difference, to eliminate the difference between the detected common rail pressure PCk and the target common rail pressure PC0, so that a reliability of the common rail fuel injection system is improved. ps Second Embodiment A common rail fuel injection system according to a second embodiment of the present invention is described below referring to FIG. 4. In the following second and third embodiments, the same referential numerals indicate the same functional components as in the first embodiment. In the second and third embodiments, the actuator 28 differs from that in the first embodiment. In the followings are described only differentiae from the first embodiment.

In the first embodiment, as the actuator to displace the pushing rod 41 in the axial direction, an example is shown to use the step motor 31 and the rotational/axial direction transformer 32.

Correspondingly, in the second embodiment, a piezoelectric actuator 51 that is a stack of piezoelectric devices 51*a* directly displaces the pushing rod 41 in the axial direction.

The piezoelectric actuator 51 changes its extension amount in its axial direction (in a stacking direction of piezoelectric devices 51*a*) in accordance with an applied voltage.

Thus, the actuator controller 29 in the second embodiment 2 executes an open control of the applied voltage that is applied to the piezoelectric actuator 51 in accordance with the target common rail pressure PC0. That is, the actuator controller 29 is provided with a map or a computing equation to determine the applied voltage in accordance with the target common rail pressure PC0, and executes the open control of the applied voltage that is applied to the piezoelectric actuator 51 based on the target common rail pressure PC0 determined by the target common rail pressure calculator.

Further, as in the case of the first embodiment, the second embodiment is provided with an initialization means that equalizes the applied voltage with the target common rail pressure PC0 at a time prior to shipping. The initialization means in the second embodiment is such one that the rotational amount described in the first embodiment is substituted by the applied voltage. A further explanation of the initialization means is omitted here.

Furthermore, as in the case of the first embodiment, the second embodiment is provided with a learning function that corrects the applied voltage that is applied to the piezoelectric actuator 51 when the detected common rail pressure PCk differs from the target common rail pressure PC0 to equalize the detected common rail pressure PCk with the target common rail pressure PC0. The learning function in the second embodiment is such one that the rotational amount in the explanation of the learning function of the first embodiment is substituted by the impressed voltage. A further explanation of the learning function is omitted here.

As in the second embodiment, the use of the piezoelectric actuator 51 as an example of the actuator 28 serves the same effect as in the first embodiment.

Third Embodiment

Figure 5:
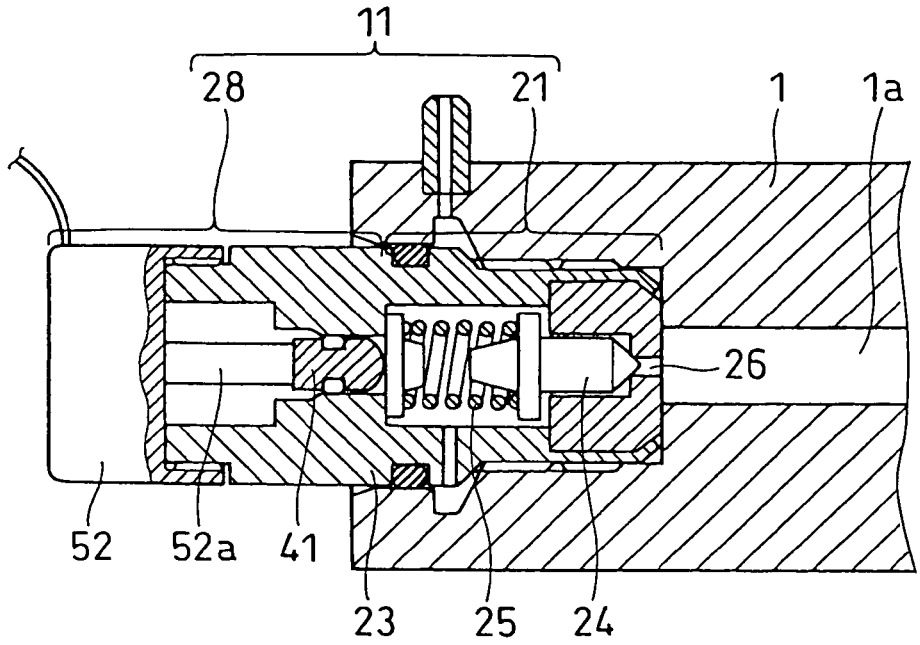
FIG. 5 is a cross-sectional view showing a pressure-reduction valve of a common rail fuel injection system according to a third embodiment.
Figure 6:
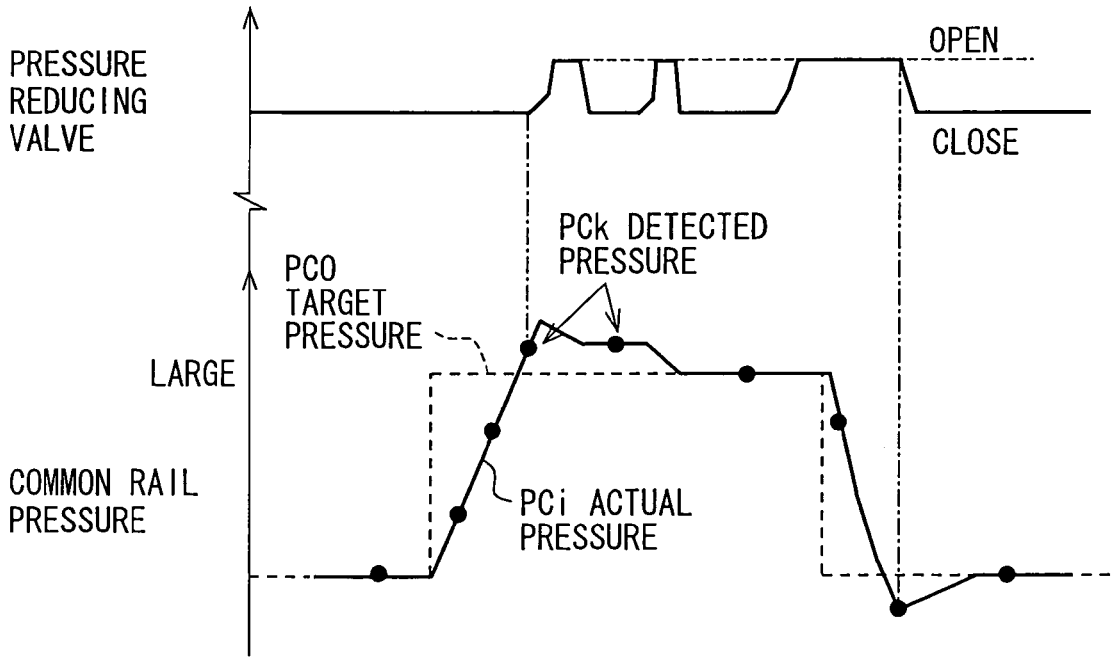
FIG. 6 PRIOR ART
FIG. 6 is a timing chart showing an opening and closing operations of a pressure-reduction valve and variations of a target common rail pressure and an actual common rail pressure by a conventional common rail fuel injection system.

A common rail fuel injection system according to a third embodiment is described below referring to FIG. 5.

In the third embodiment, a linear solenoid 52, which drives a mover (armature) 52*a* by an electromagnetic force, is used for the actuator 28, and the linear solenoid 52 directly displaces the pushing rod 41 in the axial direction.

The linear solenoid 52 is configured so that the mover 52*a* is driven in the axial direction by an applied current to an electromagnetic coil, which is not shown.

Thus, the actuator controller 29 in the second embodiment executes an open control of the applied current that is applied to the linear solenoid 52 in accordance with the target common rail pressure PC0. That is, the actuator controller 29 is provided with a map or a computing equation to determine the applied current in accordance with the target common rail pressure PC0, and executes the open control of the applied current that is applied to the linear solenoid 52 based on the target common rail pressure PC0 determined by the target common rail pressure calculator.

Further, as in the case of the first embodiment, the third embodiment is provided with an initialization means to equalize the applied current with the target common rail pressure PC0 at a time prior to shipment. The initialization means in the third embodiment is such one that the rotational amount in the explanation of the initialization means of the first embodiment is substituted by the applied current. A further explanation of the initialization means is omitted.

Furthermore, as the first embodiment, the third embodiment is provided with a learning function that corrects the applied current that is applied to the linear solenoid 52 when the detected common rail pressure PCk differs from the target common rail pressure PC0 to equalize the detected common rail pressure PCk to the target common rail pressure PC0. The learning function in the third embodiment is that a rotational amount in the explanation of the learning function of the first embodiment is replaced with the applied current. A further explanation of the learning function is omitted.

As in the second embodiment, the use of the linear solenoid 52 as an example of the actuator 28 serves the same effect as in the first embodiment.

Modified Embodiments

In the above-described embodiments are shown the examples to execute an operation to change the opening degree of the SCV 12 in accordance with the changes of the target common rail pressure PC0. However, it is possible to eliminate the SCV 12 by setting a discharge amount of the high-pressure pump to one capable of obtaining a maximum target common rail pressure so that the actual common rail pressure PCi of the common rail 1 is equalized with the target common rail pressure PC0 only by a control to change the valve-opening pressure of the pressure-reduction valve 11 into the target common rail pressure PC0.

In the above-described embodiments are shown such examples that the pressure-reduction valve 11 is provided in the common rail 1. Alternatively, the pressure-reduction valve 11 may be placed at any position (between the high-pressure pump and the injector 2) in which the common rail pressure (injection pressure) is generated.

In the above-described embodiments are shown such examples that the step motor 31, the rotational/axial direction transformer 32, the piezoelectric actuator 51 and the linear solenoid 52 are used as examples of the actuator 28. Alternatively, the spring force of the spring 25 may be varied by uses of other kinds of the actuator.

In the above-described embodiments are shown such examples that the compression coil spring is used for the spring 25, and the actuator 28 varies the compression amount of the spring 25. Alternatively, other kinds of the spring member such as a spiral spring or the leaf spring may be used for the spring 25. Rotational actuators and the like that can vary the spring force of the spring member 25 may also be used.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A common rail fuel injection system for an internal combustion engine comprising:

a high-pressure pump that feeds a high-pressure fuel;

a common rail that accumulates the high-pressure fuel fed by the high-pressure pump;

an injector that injects the high-pressure fuel accumulated in the common rail;

a target common rail pressure calculator that calculates a target common rail pressure in accordance with a driving state of the internal combustion engine;

a valve device that opens when an actual common rail pressure in the common rail exceeds a predetermined valve-opening pressure to flow the high-pressure fuel in the common rail to a low-pressure system; and a valve-opening pressure changer that changes the valve-opening pressure of the valve device into the target common rail pressure, wherein:

the valve device is provided with a fixing member having a high-pressure passage communicated with the common rail, a valve body capable of blocking the high-pressure passage, and a spring urging the valve body to block the high-pressure passage;

the valve-opening pressure changer is provided with an actuator that varies a spring force of the spring, and an actuator controller that controls the actuator to change the valve-opening pressure into the target common rail pressure;

the valve device and the actuator are integrally provided as a pressure-reduction valve; and the actuator comprises a direction transformer for changing a compression amount of the spring and a motor for driving the direction transformer.

2. The common rail fuel injection system according to claim 1, wherein the actuator controller executes an open control of the actuator based on the target common rail pressure.

3. A common rail fuel injection system for an internal combustion engine comprising:

a high-pressure pump that feeds a high-pressure fuel;

a common rail that accumulates the high-pressure fuel fed by the high-pressure pump;

an injector that injects the high-pressure fuel accumulated in the common rail;

a target common rail pressure calculator that calculates a target common rail pressure in accordance with a driving state of the internal combustion engine;

a valve device that opens when an actual common rail pressure in the common rail exceeds a predetermined valve-opening pressure to flow the high-pressure fuel in the common rail to a low-pressure system; and a valve-opening pressure changer that changes the valve-opening pressure of the valve device into the target common rail pressure, wherein the valve device is provided with a fixing member having a high-pressure passage communicated with the common rail, a valve body capable of blocking the high-pressure passage, and a spring urging the valve body to block the high-pressure passage;

the valve-opening pressure changer is provided with an actuator that varies a spring force of the spring, and an actuator controller that controls the actuator to change the valve-opening pressure into the target common rail pressure;

the valve device and the actuator are integrally provided as a pressure-reduction valve, the actuator controller executes an open control of the actuator based on the target common rail pressure; and the actuator controller is provided with an initialization means that executes:

a minimum pressure-side initialization operation to memorize a minimum pressure control value when the valve device opens or closes in gradually actuating the actuator in a state that the actual common rail pressure equivalent to a minimum target common rail pressure is generated in a memory device; and a maximum-pressure-side initialization operation to memorize a maximum pressure control value when the valve device opens or closes in gradually actuating the actuator in a state that the actual common rail pressure equivalent to a maximum target common rail pressure is generated in the memory device at a time prior to shipping, and the actuator controller calculates an open control value by interpolating between the minimum pressure control value and the maximum pressure control value memorized in the memory device in determining the open control value corresponding to the target common rail pressure in a normal driving time.

4. A common rail fuel injection system for an internal combustion engine comprising:

a high-pressure pump that feeds a high-pressure fuel;

a common rail that accumulates the high-pressure fuel fed by the high-pressure pump;

an injector that injects the high-pressure fuel accumulated in the common rail;

a target common rail pressure calculator that calculates a target common rail pressure in accordance with a driving state of the internal combustion engine;

a valve device that opens when an actual common rail pressure in the common rail exceeds a predetermined valve-opening pressure to flow the high-pressure fuel in the common rail to a low-pressure system; and a valve-opening pressure changer that changes the valve-opening pressure of the valve device into the target common rail pressure, wherein the valve device is provided with a fixing member having a high-pressure passage communicated with the common rail, a valve body capable of blocking the high-pressure passage, and a spring urging the valve body to block the high-pressure passage;

the valve-opening pressure changer is provided with an actuator that varies a spring force of the spring, and an actuator controller that controls the actuator to change the valve-opening pressure into the target common rail pressure;

the valve device and the actuator are integrally provided as a pressure-reduction valve, the actuator controller executes an open control of the actuator based on the target common rail pressure; and further comprising a common rail pressure sensor that detects a common rail pressure accumulated in the common rail, wherein the actuator controller is further provided with: a correction value calculator that determines a correction value for the actuator to eliminate a pressure difference when a detected common rail pressure detected by the common rail pressure sensor differs from the target common rail pressure; a memorization executor that memorizes the correction value calculated by the correction value calculator in a memory device; and a correction executer that corrects an open control value applied to the actuator based on the correction value memorized in the memory device.

5. The common rail fuel injection system according to claim 1, wherein:

the direction transformer comprises a spline member and a pushing rod coupled with the spline member so that the pushing rod can move back and force when it is rotated; and the motor comprises a step motor that has a rotation shaft connected to the pushing rod to rotate the pushing rod.

6. The common rail fuel injection system according to claim 1, wherein:

the direction transformer comprises a piezoelectric device and a pushing rod coupled with the piezoelectric device so that it can drive the pushing rod back and force when it is rotated applied a control voltage.

7. A common rail fuel injection system for an internal combustion engine comprising:

a high-pressure pump that feeds a high-pressure fuel;

a common rail that accumulates the high-pressure fuel fed by the high-pressure pump;

an injector that injects the high-pressure fuel accumulated in the common rail;

a target common rail pressure calculator that calculates a target common rail pressure in accordance with a driving state of the internal combustion engine;

a valve device, provided with a fixing member having a high-pressure passage communicated with the common rail, a valve body capable of blocking the high-pressure passage, and a spring urging the valve body to block the high-pressure passage, said valve body opening when an actual common rail pressure in the common rail exceeds a predetermined valve-opening pressure to discharge the high-pressure fuel in the common rail to a low-pressure system; and a valve-opening pressure changer, provided with an actuator that varies a spring force of the spring, and an actuator controller that controls the actuator to change the valve-opening pressure into the target common rail pressure, for changing the valve-opening pressure of the valve device into the target common rail pressure, wherein the actuator comprises a pushing rod that changes a compression degree of the spring and a motor unit that drives the pushing rod.

8. The common rail fuel injection system according to claim 7, wherein:

the motor unit comprises an electric motor that rotates the pushing rod and a spline member disposed between the electric motor and the pushing rod to move the pushing rod toward the spring when the electric motor rotates.

9. The common rail fuel injection system according to claim 7, wherein:

the motor comprises a piezoelectric device that drives the pushing rod toward the spring when it is applied a control voltage.

* * * * *